United States Patent [19]

Meijer et al.

[11] 4,152,830

[45] May 8, 1979

[54] HAIR-CUTTING

[75] Inventors: Albert J. Meijer; Albertus P. Rentema, both of Drachten, Netherlands

[73] Assignee: U.S. Philips Corporation, New York, N.Y.

[21] Appl. No.: 859,745

[22] Filed: Dec. 12, 1977

[30] Foreign Application Priority Data

Jan. 19, 1977 [NL] Netherlands ..... 7700504

[51] Int. Cl.[2] ..... B26B 19/22

[52] U.S. Cl. ..... 30/195; 30/201

[58] Field of Search ..... 30/195, 201, 202

[56] References Cited

U.S. PATENT DOCUMENTS 2,292,364 8/1942 Cromonic ..... 30/201

3,093,901 6/1963 Wahl ..... 30/201

3,999,295 12/1976 DuBois ..... 30/195

*Primary Examiner*—Jimmy C. Peters

*Attorney, Agent, or Firm*—Thomas A. Briody; William J. Streeter; Rolf E. Schneider

[57] ABSTRACT

A hair-cutting apparatus has a drivable cutter and a stationary cutter, each of which has teeth extending transversely to the direction of driving, the cutting edges of two co-operating teeth enclosing a cutting angle. Mechanism is provided for variably adjusting the position of the two cutters relative to each other in a direction substantially transverse to the direction of driving, the shape of the cutting edges of the respective teeth being such that the mangitude of the cutting angle is variable depending on the adjusted position.

4 Claims, 6 Drawing Figures

HAIR-CUTTING

This invention relates to a hair-cutting apparatus with a drivable cutter and a counter-cutter, the two cutters each having a row of teeth, which teeth extend substantially tranversely to the direction of driving and the cutting edges of two co-operating teeth of the drivable cutter and the counter-cutter enclosing a cutting angle.

Such a hair-cutting apparatus is for example known from U.S. Pat. No. 3,962,785.

It is often of importance that the cutting properties of such an apparatus can be varied in accordance with the purpose for which it is used, such as cutting, trimming, thinning etc, whilst it is also desirable that the cutting properties of the apparatus can be adapted to the skill of the user.

It is an object of the present invention to provide such an adjustment possibility of the cutting properties and to provide a hair-cutting apparatus of the type described above, which is characterized in that the position of the cutters relative to each other is adjustable in a direction which is substantially transverse to the direction of driving, the magnitude of the cutting angle being variable depending on this adjustable position of the cutters.

A preferred embodiment is characterized in that the cutting edges of the teeth of at least one of the cutters have a kinked but otherwise rectilinear shape.

Another preferred embodiment is characterized in that the cutting edges of the teeth of at least one of the cutters have a curved shape.

A simple construction for adjusting for example the drivable cutter relative to the counter-cutter is characterized in that the drivable cutter is supported and guided by a pivotable bracket which is journalled in the counter-cutter.

The invention will now be described in more detail with reference to the accompanying drawing, in which:

FIG. 1 in perspective and schematically shows a part of a hair-cutting apparatus with cutters.

Figure 1:
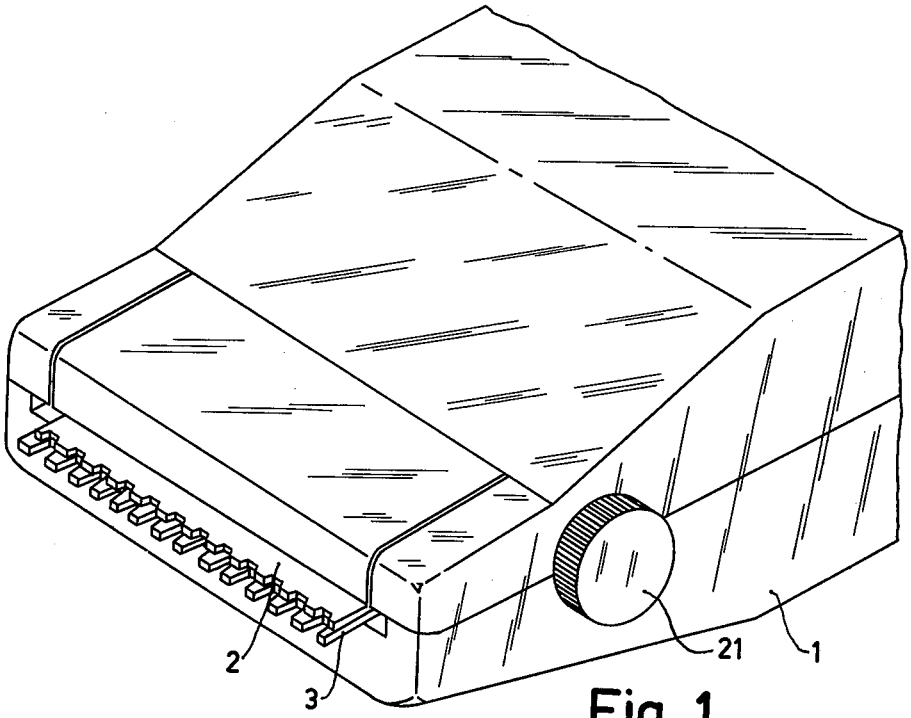

As is shown in FIG. 1 the hair-cutting apparatus comprises a holder 1 with a drivable cutter 2 and a counter cutter 3. Such apparatus may take the form of a self-contained unit, a motor and a transmission mechanism for driving the cutter 2 being accommodated in the holder. Such a hair-cutting apparatus may also form part of a shaving apparatus with a separate shaving head for beard hairs, for which generally a common drive motor is used.

Figure 2:
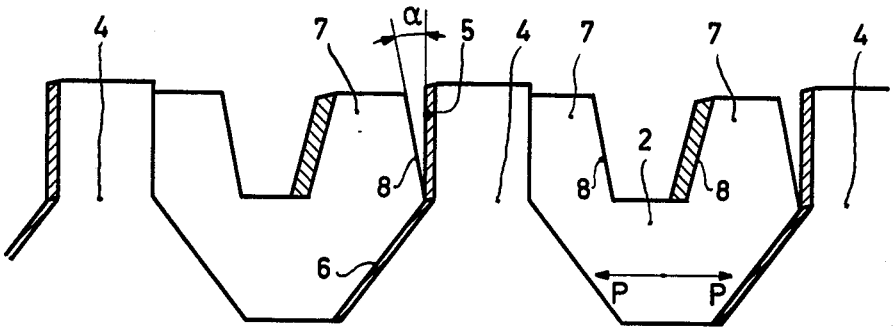
FIGS. 2 and 3 show an example of a set of cutters, the cutting edges of the teeth of one of the cutters having a kinked but otherwise rectilinear shape.
Figure 3:
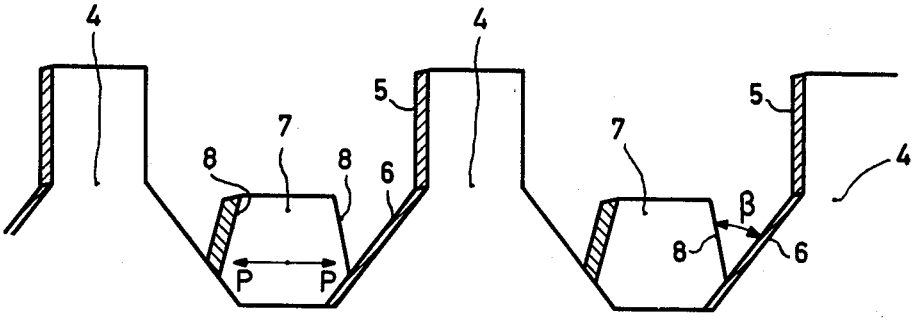

In the example shown in FIGS. 2 and 3 the cutting edges of the teeth 4 of counter-cutter 3 have a kinked but otherwise rectilinear shape. A distinction can then be made between a part 5 and a part of 6 of each such cutting edge, which make different angles with the direction of driving as indicated by the arrows P. The teeth 7 of the drivable cutter 2 have straight cutting edges 8.

In the position shown in FIG. 2 the edges 5, when the cutter 2 is driven, co-operate with the cutting edges 8, said cutting edges making a cutting angle $\alpha$ with each other. In the position shown in FIG. 3 in which in comparison with the position of FIG. 2 the drivable cutter 2 has been moved relative to the counter cutter 3 in a direction transverse to the direction of driving P, tooth flank 6 co-operates with tooth flank 8, yielding a greater cutting angle $\beta$. In the position of the cutters of FIG. 3 the hair-cutting apparatus will cut less effectively than in the position of the cutters in accordance with FIG. 2.

Figure 4:
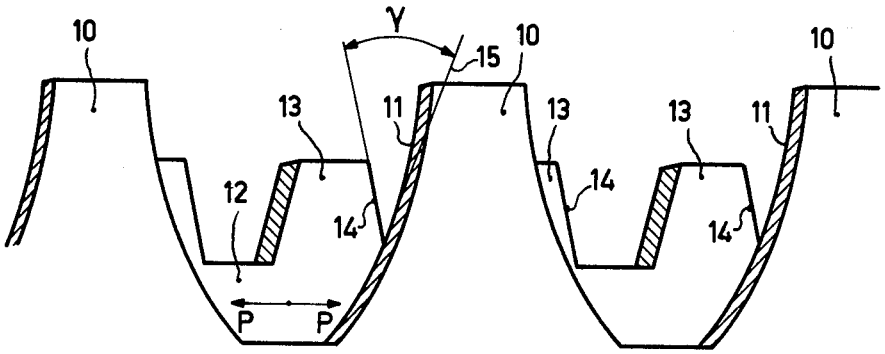
FIG. 4 shows an example of a set of cutters, the cutting edges of one of the cutters having a curved shape.

FIG. 4 shows a counter-cutter 9 with teeth 10 having curved cutting edges 11. The cutting angle may then be defined as the angle $\gamma$ between the cutting edge 14 of a tooth 13 of the drivable cutter 12 and the tangent 15 to the cutting edge 11 in at the point of intersection of the cutting edges 11 and 14. When the drivable cutter 12 is adjusted relative to the counter cutter in a direction transverse to the direction of driving P the cutting angle $\gamma$ will vary continuously.

Obviously, the cutting edges of the teeth of both cutters may also have a curved shape or a kinked shape. The cutting edge of a tooth may exhibit several kinks or a combination of a kinked shaped and a curved shape. Moreover, the counter-cutter or both cutters may be adjustable in a direction which is substantially transverse to the direction of driving.

Figure 5:
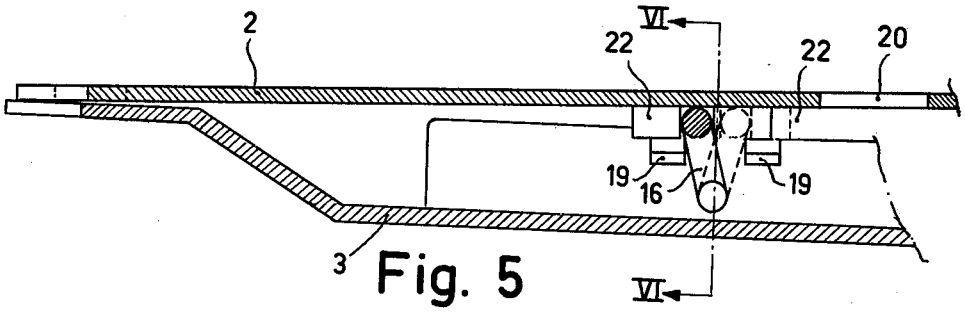
FIG. 5 is a cross-section, in part, of a set of cutters taken on the line V—V of FIG. 6.
Figure 6:
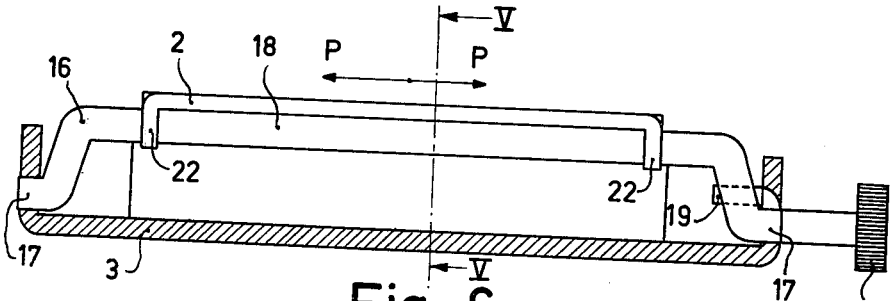
FIG. 6 is a cross-section of a set of cutters taken on the line VI—VI of FIG. 5.

For adjusting the drivable cutter 2 it is for example possible to use a mechanism as shown in FIGS. 5 and 6. Here use is made of a bracket 16 which is pivotable between two positions and whose ends 17 are journalled in the counter-cutter 3. The drivable cutter 2 has bent tabs 22 which are disposed on both sides of the central portion 18 of the bracket 16, so that during the reciprocating movement of the drivable cutter in the direction of the arrow P the drivable cutter is guided by the central portion 18. By rotating the bracket 16 into a position as is shown by the dashed lines in FIG. 5, the drivable cutter 2 can be moved relative to the counter-cutter 3 in a direction transverse to the direction of driving. Both cutters are pressed against each other by spring force in known manner. The two positions of the bracket are limited by stops 19. The drivable cutter 2 is generally driven with the aid of an oscillating lever which is not shown for the sake of simplicity and which is provided with a cam which engages with an opening 20 in the drivable cutter 2. This opening is oblong in a direction transverse to the direction of driving so as to enable the drivable cutter to move when the bracket 16 is rotated. The bracket 16 may for example be rotated with the aid of an actuating knob 21 which projects from the holder (also see FIG. 1).

The number of hairs caught between two co-operating teeth of the drivable cutter and the counter-cutter and in particular the percentage of said hairs cut in a single cutting cycle greatly depend on the cutting angle. As described hereinbefore, the cutting properties of the hair-cutting apparatus can be varied in a simple manner. A position of the cutters in which the cutting action is less effective than the optimum cutting action attainable with the apparatus, may for example be suitable for so-called thinning. An unskilled person will preferably adjust the apparatus to a position of the cutters in which the cutting properties are not optimum, so that there is less risk of too much hair being cut off.

What is claimed is:

1. A hair-cutting apparatus which comprises a drivable cutter; means to drive said drivable cutter; a counter-cutter; the two cutters each having a row of teeth extending substantially transversely to the direction of driving, the cutting edges of two co-operating teeth of the drivable cutter and the counter-cutter enclosing a cutting angle, and the shape of the cutting edges of the teeth of one of said cutters being different from the shape of the cutting edges of the teeth of the other cutter; and means to adjust the position of the two cutters relative to each other in a direction substantially transverse to the direction of driving, the magnitude of the cutting angle thereby varying according to the adjusted position of the two cutters.

2. A hair-cutting apparatus according to claim 1, in which the cutting edges of the teeth of said one cutter have a kinked but otherwise rectilinear shape.

3. A hair-cutting apparatus according to claim 1, in which the cutting edges of the teeth of said one cutter have a curved shape.

4. A hair-cutting apparatus according to claim 1, in which the adjusting means includes a pivotable bracket journalled in the counter-cutter for supporting and guiding the drivable cutter, and means provided on the underside of the drivable cutter for engagement by the pivotable bracket.

* * * * *